United States Patent [19]

Szántó et al.

[11] Patent Number: 4,843,266

Date of Patent: Jun. 27, 1989

[54] METAL-HALOGEN DISCHARGE LAMP WITH CONICALLY SHAPED INSULATING ELEMENTS IN OUTER ENVELOPE

[75] Inventors: János Szántó, Budapest; Sándor Holló, Eger; Balázs Nyiri; Ferenc Nágel, both of Budapest, all of Hungary

[73] Assignee: Tungsram Reszvenytarsasag, Hungary

[21] Appl. No.: 109,960

[22] Filed: Oct. 19, 1987

[30] Foreign Application Priority Data

Oct. 20, 1986 [HU] Hungary ..... 4339/86

[51] Int. Cl.[4] ..... H01J 61/30

[52] U.S. Cl. ..... 313/25

[58] Field of Search ..... 313/25

[56] References Cited

U.S. PATENT DOCUMENTS

| | | | |
|---|---|---|---|
| 2,671,183 | 3/1954 | St. Louis et al. | 313/25 X |
| 2,748,303 | 5/1956 | Thorington | 313/25 |
| 3,484,637 | 12/1969 | Van Boort et al. | 313/25 |
| 4,229,673 | 10/1980 | McAllister | 313/634 X |
| 4,479,071 | 10/1984 | T'jampens et al. | 313/25 |

*Primary Examiner*—Palmer C. DeMeo

*Attorney, Agent, or Firm*—Handal & Morofsky

[57] ABSTRACT

The invention relates to a metal-halogen discharge lamp with an alkali-halide additive. The lamp consists of the discharge tube (2), the outer bulb (1), the current leads (3) led into the discharge tube (2) through the outer bulb (1). The discharge lamp according to the invention can be characterized in that the metal components arranged in the outer bulb of the discharge lamp and connected electrically to the mains are separated by a material insulating against alkali ions or alkali ions and electrons.

5 Claims, 5 Drawing Sheets

METAL-HALOGEN DISCHARGE LAMP WITH CONICALLY SHAPED INSULATING ELEMENTS IN OUTER ENVELOPE

BACKGROUND OF THE INVENTION

The invention relates to a metal-halogen lamp containing alkali-halide additive, comprising a discharge tube, an outer bulb, current leads led into the discharge tube through the outer bulb, and in some embodiments a current-carrying and holding metal armature.

In course of the operation of metal halogen discharge lamps containing alkali-halides as an additive the alkali ions with a small diameter can penetrate easily through the quartz discharge-tube. As a consequence, the alkali loss occuring in the discharge space results in colour instability, increase of burning voltage and loss of life of the lamp. A majority of the presently produced metal-halogen discharge lamps contain sodium as an additive. Accordingly, examination of alkali reduction and the construction recommended for the restraint thereof are related primarly to sodium, however, the methods can be well applied to other alkali additives too.

Earlier interpretations (J. F. Waymouth: Electric Discharge Lamps, MIT-Press, 1971, p: 226–276) explain Na-reduction in the following manner. Metal armatures built-in into the outer bulb of the lamp are under electric voltage, they induce an electric field between the discharge tube and the current lead-in armatures. At the same time, the UV-light emitted by the discharge tube releases photoelectrons from the metal armatures of the outer bulb, which—when arriving at the wall of the quartz discharge tube—charge the outer wall of the discharge tube and re-electrolyse the Na-ions on the quartz wall, promote wandering of the Na-ions, which are neutralized on the surface of the discharge tube. Thereafter atomic Na evaporates from the surface of the discharge tube and as neutral Na-atoms do not influence potential conditions, the process will be repeated.

The construction as specified in the U.S. Pat. No. 3 424 935 tends to solve the aforementioned problem. In this case it was tried to reduce electric field intensity in the quartz wall of the discharge tube and simultaneously to reduce the number of photoelectrons arriving at the quartz wall so that current is led to the upper end of the quartz discharge tube through a thin lead, while the lead is arranged the possibly farthest from the discharge tube along the outer bulb and bent to the curvature thereof. According to sense, with the solution the aforementioned current lead loses the function of a holder, the role of holding is overtaken by a separate construction. Rightness of the theory is proved by the fact that the construction utilizing said theory is able to reduce Na loss considerably, from 2.0 mg/1000 h to 0.24 mg/1000 h.

According to another solution disclosed in the U.S. Pat. No. 3 484 637, the current lead-in electrode passing along the discharge tube and fulfilling simultaneously the role of the holder as well as metal parts being on the most critical electric potential are coated with some substance being impermeable for UV-radiation, so e.g. a ceramic tube is pulled thereon.

Hungarian Pat. No. 182 221 discloses a solution for reducing Na-losses, according to which those parts of the high-pressure discharge lamps which form a part of the circuit producing Na-losses are coated with silicon nitride for the sake of insulation. In this way both photoelectric and ion-emission processes are reduced. Outside of the discharge tube, as well as armatures within the outer bulb are coated with a silicon nitride layer by precipitating from the vapour phase, representing a method known per se.

As none of the aforementioned measures has been suitable—inspite of every advantageous effect—to solve the problem of sodium losses of the discharge tube, research activity in this field continued. The recognition, in so far as sodium leaves the surface of the discharge tube in the form of Na-ions, passing through the quartz, meant a new situation. (F. Nágel, et. al.: High Temperature Chemistry, Vol. 85-2, p. 72, Toronto, 1985, as well as F. Nágel et al. 4. International Symposium on the Science and Technology of Light Sources, p. 97, Karlsruhe, 1986). Potential conditions of the metal parts of the discharge lamp influence considerably emission of sodium ions from the surface of the discharge tube, as well as their motion within the outer bulb. Positive sodium ions move in a given moment to the metal parts on negative potential and become neutralized by electron reception. In such a manner the differential potential between the metal components and the discharge tube is maintained, flow of sodium ions does not stop.

The invention is based on the recognition, in so far as in order to stop sodium losses of discharge tubes, the metal parts, i.e. current leads carrying an electric potential in the discharge tube are to be insulated in respect to sodium ions and electrons, i.e. they are to be screened from the discharge tube. In accordance with the invention the sodium ions emitting from the discharge tube, i.e. the quartz body, impact on a surface in course of their motion to the metal parts carrying a potential, through which they cannot penetrate. At the same time this surface does not allow motions of the electrons, thus sodium ions cannot be neutralized. In such a manner the accumulated sodium ions with their positive electric field hinder the motion of further sodium ions in the wall of the quartz body discharge tube substantially preventing their emission from the surface of the discharge tube.

This argumentation does not relate solely to sodium but also to other alkali additives (Li, K, Rb) that may be used in the discharge tube and being mobile at the operative temperature of the discharge tube.

Accordingly, the invention relates to a metal-halogen discharge lamp containing an alkali halide additive, comprising a discharge tube, an outer bulb, current leads led into the discharge tube through the outer bulb, and often the current leading and carrying metal armatures.

SUMMARY OF THE INVENTION

The discharge lamp according to the invention can be characterized in that the metal components in the outer bulb of the discharge lamp, and connected electronically to a voltage source, are separated from the active part of the discharge tube by a material insulating against alkali ions or alkali ions and electrons.

In such a manner the task set for the invention is solved, namely emission of alkali metals, in particular of sodium from the quartz discharge tube is prevented to a considerable extent, thereby reducing alkali losses in the discharge tube with all the accompanying detrimental effects of such losses.

The invention will be described in detail by means of an example for practical realization with reference to the accompanying drawings, wherein:

DETAILED DESCRIPTION OF THE DRAWINGS

Figure 1:
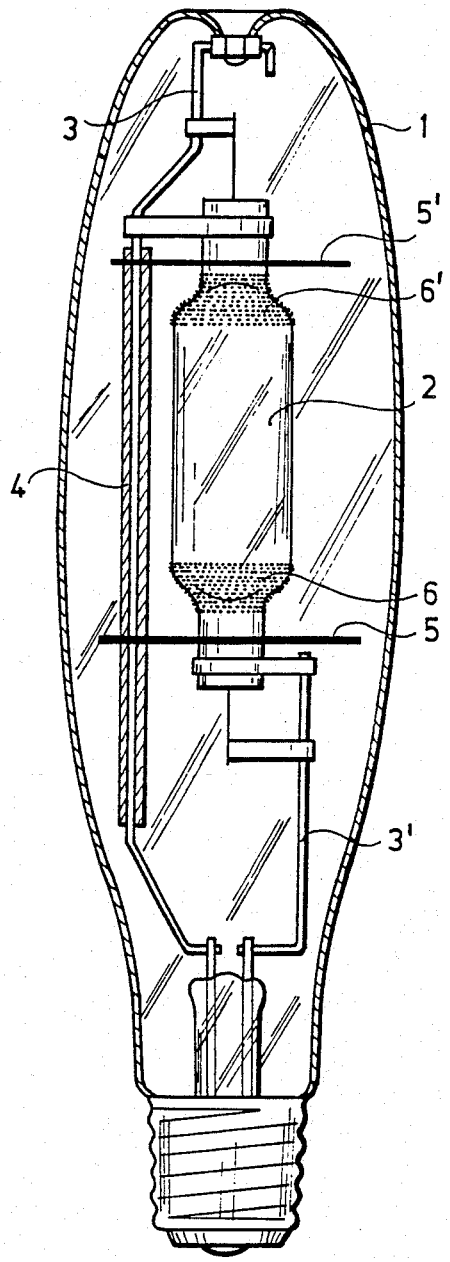
FIG. 1 is a longitudinal sectional view of a single base discharge lamp according to the invention with two insulating discs.

With the embodiment illustrated in FIG. 1, on a current lead 3 of a discharge tube 2 arranged in an outer bulb 1, is covered by an insulating pipe 4 made of hard-glass, an insulating disc 5 is arranged on the flattened ends 6, 6' of the discharge tube 2. These insulators block the path of the sodium ions to the current leads 3 and the ions after having been charged prevent the emission of further Na-ions from the surface of the discharge tube 2.

Figure 2:
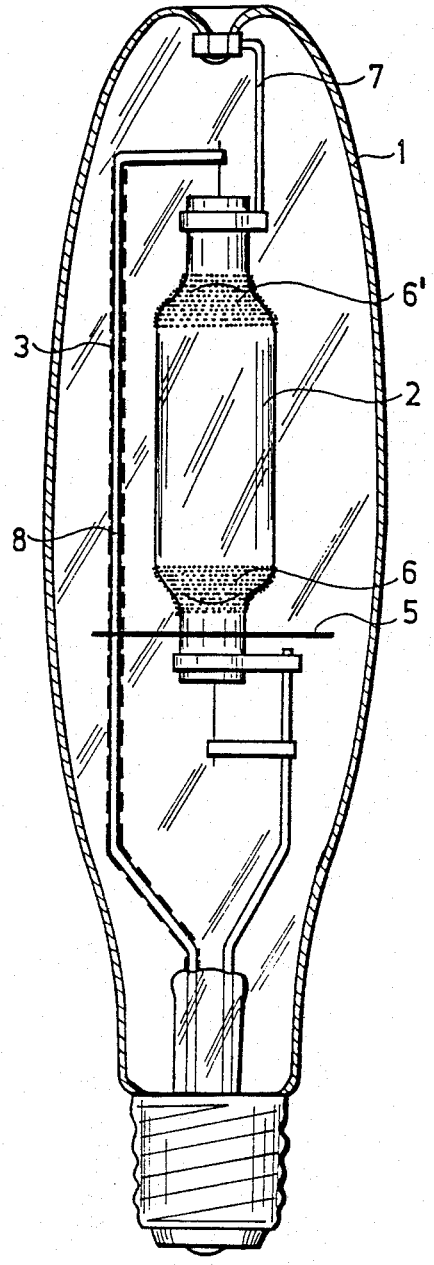
FIG. 2 is a longitudinal sectional view of a single base discharge lamp according to the invention with one insulating disc.

FIG. 2 shows a modified version of the discharge lamp according to FIG. 1. With this embodiment a holder 7 fixing the upper flattened end 6' of the discharge lamp is not connected electrically to the current lead 3. Electric current is led in a wire coated with a material which can be characterized with a low mobility of alkali (in case of a Mo current lead with hard-glass of type GE 180, with a tungsten lead with hard-glass of type TUNGSRAM AM7) to the flattened upper end 6' of the discharge tube. The flattened tube end 6 of the discharge tube 2 is connected, as in FIG. 1, with the above mentioned insulating disc 5 should.

The insulating disc 5 can be made of mica, mica coated with MgO or other similar metal, oxide ceramic or glass, or metal insulated electrically from the current leads 3.

Figure 3:
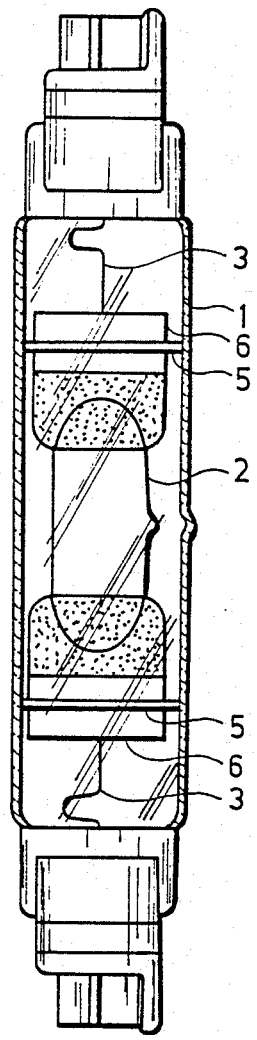
FIG. 3 shows the solution according to FIG. 1 realized as double base tubular lamp.

FIG. 3 illustrates the application of the embodiments according to FIGS. 1 and 2 for tubular lamps.

Figure 4:
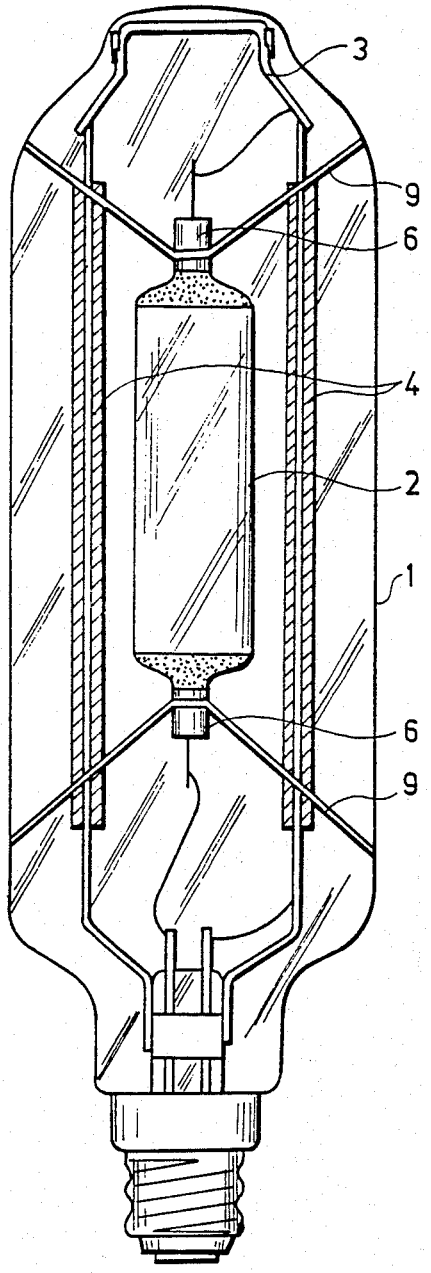
FIG. 4 is the longitudinal sectional view of a single base discharge lamp according to the invention with conical insulating elements for high-power types.

FIG. 4 shows an embodiment for high-output discharge lamps. With this embodiment conical insulating elements 9 are used having a lesser impact on the light distribution of the discharge lamp.

A further advantage of the installed insulating disc 5 and the conical insulating elements 9, respectively, lies in that by reflecting a part of the radiation coming from the discharge tube 2 the re-heating of the plasma in the discharge tube 2 can be increased, in addition, the getter arranged in the outer bulb 1 can be operated at a lower temperature.

Figure 5:
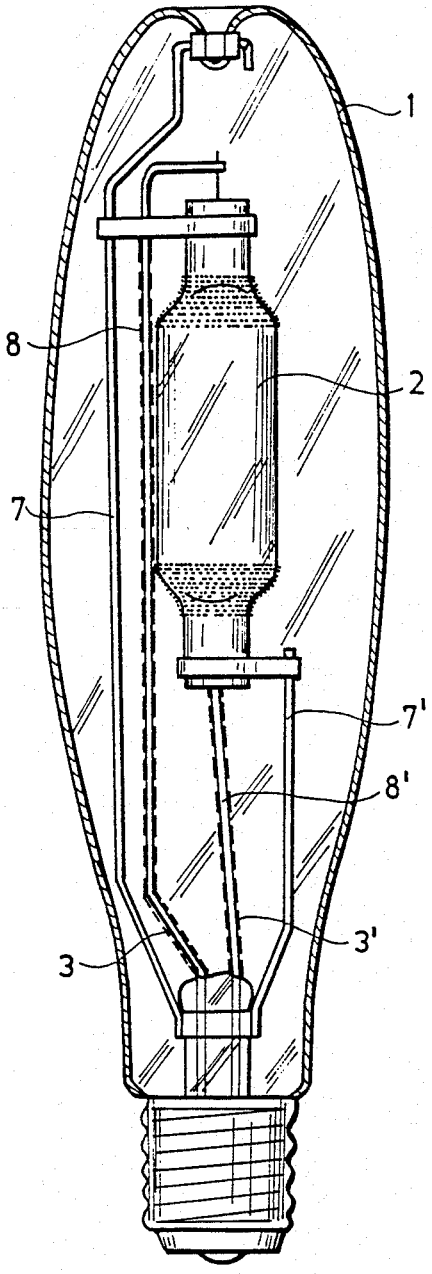
FIG. 5 is the longitudinal sectional view of the discharge lamp according to the invention with the insulated current leads.

FIG. 5 shows an embodiment for reducing sodium losses, wherein the current is led in thin current leads 3' coated with the insulating layers 8', which can be characterized with a low alkali mobility, such as hard-glass of the type GE 180 for Mo and hard-glass of the type Tungsram Am 7 for W. With this embodiment, holders 7 hold the discharge tube 2.

What we claim:

1. A metal halogen discharge lamp containing an alkali halogenoid additive comprising:

(a) a discharge tube having two ends and an active part in between;

(b) two electric leads extending out of said discharge tube, one from each end;

(c) an outer bulb with said discharge tube located therein;

(d) metal armatures extending through the outer bulb to the electric leads of said discharge tube providing support and means of current flow for said discharge tube;

(e) metal contacts on an outside portion of said outer bulb communicating with said armatures, said contacts positioned to contact a current supply to power said discharge lamp; and (f) conically shaped insulating elements positioned at each end of said discharge tube such that the active part of said discharge tube is separated from said armatures, wherein the metal armatures are coated with a ceramic or glass characterized by having poor conductivity with respect to alkali ions.

2. A discharge lamp as in claim 1 wherein said insulating elements are made of mica coated with MgO.

3. A discharge lamp as in claim 1 wherein said conically shaped insulating elements are made of ceramic.

4. A discharge lamp as in claim 1 wherein said, conically shaped insulating elements are made of glass insulating against alkali ions.

5. A metal halogen discharge lamp containing an alkali halogenoid additive comprising:

(a) a discharge tube having two ends and an active part in between;

(b) two electric leads extending out of said discharge tube, one from each end;

(c) an outer bulb with said discharge tube located therein;

(d) metal armatures extending through the outer bulb to the electric leads to said discharge tube providing support and means of current flow for said discharge tube;

(e) metal contacts on an outside portion of said outer bulb communicating with said armatures, said contacts positioned to contact a current supply to power said discharge lamp; and (f) conically shaped insulating elements positioned at each end of said discharge tube such that the active part of said discharge tube is separated from said armatures, wherein said discharge lamp is a single base lamp with a portion of each of said armatures passing between said conically shaped insulating elements, said portion being coated with a glass or ceramic characterized by having poor conductivity with respect to alkali ions.

* * * * *